United States Patent [19]

Pasanen

[11] 4,188,018

[45] Feb. 12, 1980

[54] MEANS FOR ACCELERATING THE SPEED ON A SKI JUMP

[76] Inventor: Pertti Pasanen, Fredrikinkatu 61, 00100 Helsinki 10, Finland

[21] Appl. No.: 878,923

[22] Filed: Feb. 17, 1978

[51] Int. Cl.[2] ..... B61B 11/00; B61B 12/10

[52] U.S. Cl. ..... 254/175.3; 74/194; 104/173 R; 104/178; 104/197

[58] Field of Search ..... 104/173 R, 173 ST, 178, 104/196, 197, 162; 254/175.3, 147, 187.8, 187.4; 124/1; 272/56.5 SS; 74/194, 196, 197, 207; 244/63

[56] References Cited

U.S. PATENT DOCUMENTS

| | | | |
|---|---|---|---|
| 1,628,916 | 5/1927 | Ronk | 254/187.4 |
| 2,087,232 | 7/1937 | Constam | 104/173 ST |
| 2,379,267 | 6/1945 | Wilson | 104/173 R X |
| 2,596,762 | 5/1952 | Costner | 74/194 |
| 3,861,514 | 1/1975 | Ling | 104/173 ST X |
| 3,874,303 | 4/1975 | Andren | 104/173 ST |
| 3,894,830 | 7/1975 | Edwards | 74/207 X |
| 3,942,452 | 3/1976 | Peck | 104/173 ST X |

FOREIGN PATENT DOCUMENTS

| | | | |
|---|---|---|---|
| 432574 | 9/1967 | Switzerland | 104/173 ST |

*Primary Examiner*—Randolph A. Reese
*Attorney, Agent, or Firm*—Hammond & Littell, Weissenberger & Muserlian

[57] ABSTRACT

An apparatus for towing a skier on skis to a ski-jump takeoff at an accelerating speed comparable to that given by a starting tower comprising an endless rope tow driven by a motor and transmission which supplies a pre-set constantly increasing acceleration to the endless rope tow.

17 Claims, 5 Drawing Figures

MEANS FOR ACCELERATING THE SPEED ON A SKI JUMP

BACKGROUND OF THE INVENTION

The starting towers in connection with ski jumping hills are usually constructed of concrete or timber. Such starting towers involve very high costs, and often furthermore they have an effect spoiling the scenery. Because they rise remarkably over the rest of the terrain, the wind quite often interferes with the starting run. This, as well as differences in the sliding of different skiers' skis may give the jumpers considerably different ultimate velocities. Especially owing to the high cost, good ski jumping hills are comparatively sparse and quite often the ski jumpers cannot train at the locality where they live.

OBJECTS OF THE INVENTION

The object of the present invention is to solve the problems mentioned by replacing the traditional starting tower with motor-driven towing means. The means of the invention comprises a motor, driving through an appropriate transmission an endless towing rope carrying gripping means to which the jumper may cling.

A starting means of this kind is easy to build with comparatively minor cost at any place where there is a suitable hillside for the jumpers to land on.

The other characteristics, details and peculiarities of the invention will be apparent from the subsequent description, wherein a preferred embodiment example of the invention is presented with reference being made to the attached drawings, wherein FIG. 1 shows in schematic elevational view, a means according to the invention.

Figure 4:
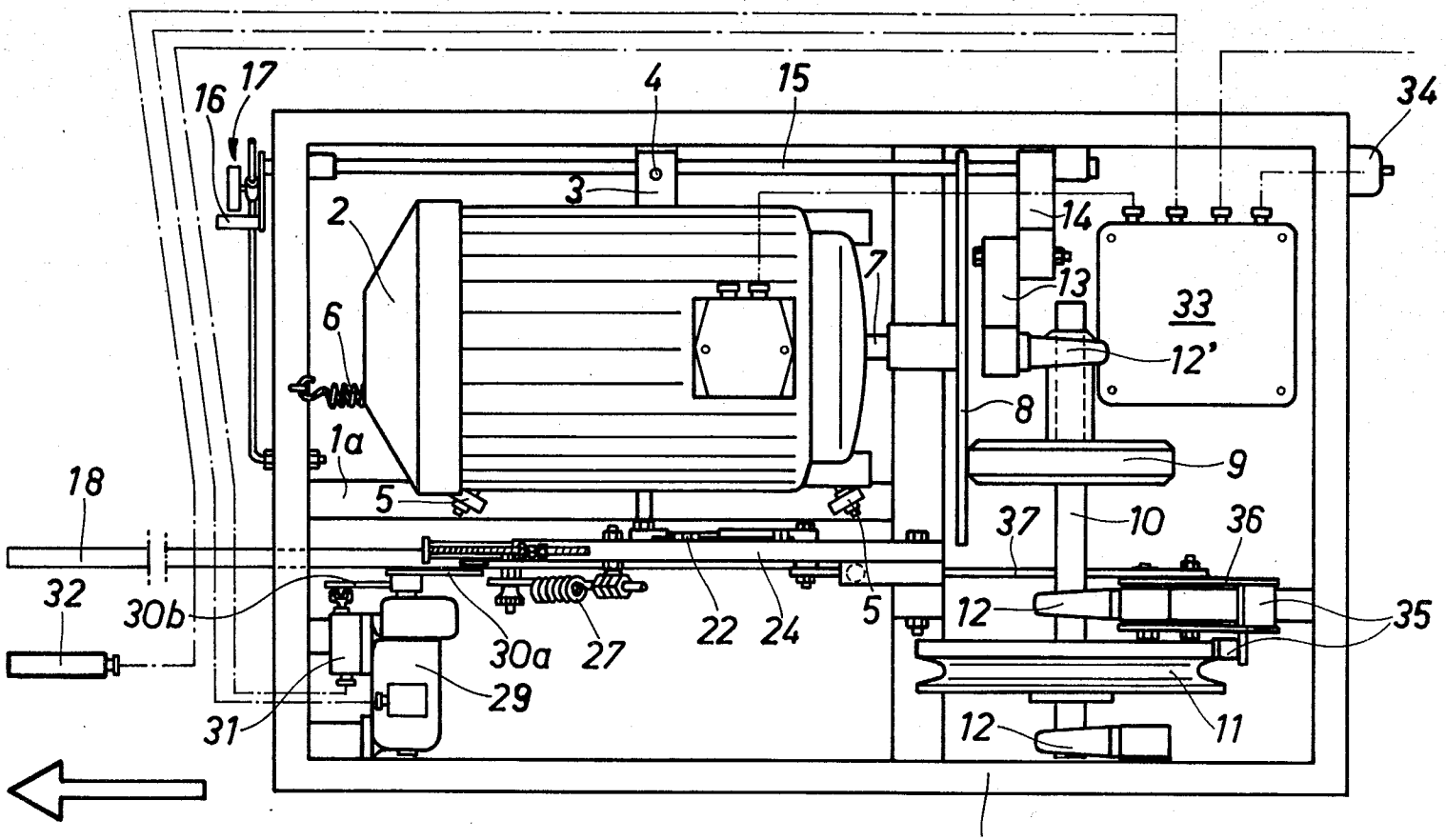
Figure 5:
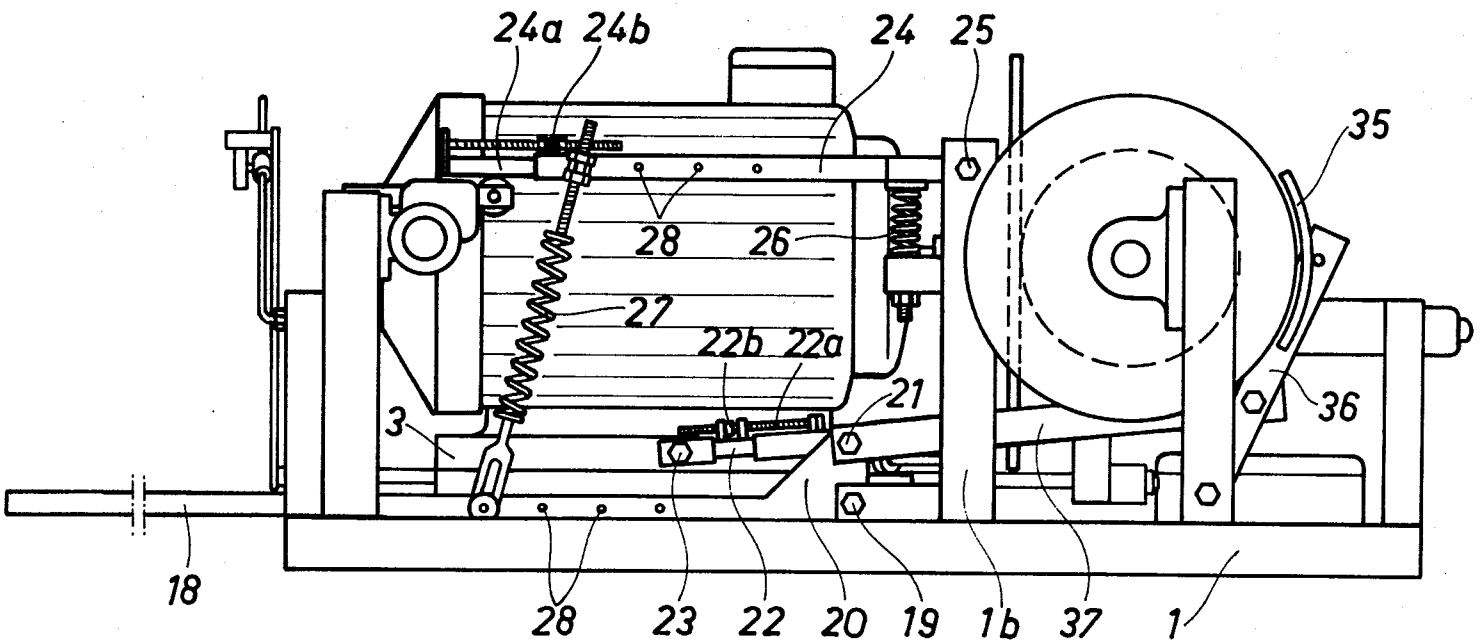

FIG. 4 presents the motor employed in the means of the invention, together with its transmission mechanism, in top view, and FIG. 5 shows the same as FIG. 4, in elevational view.

Figure 1:
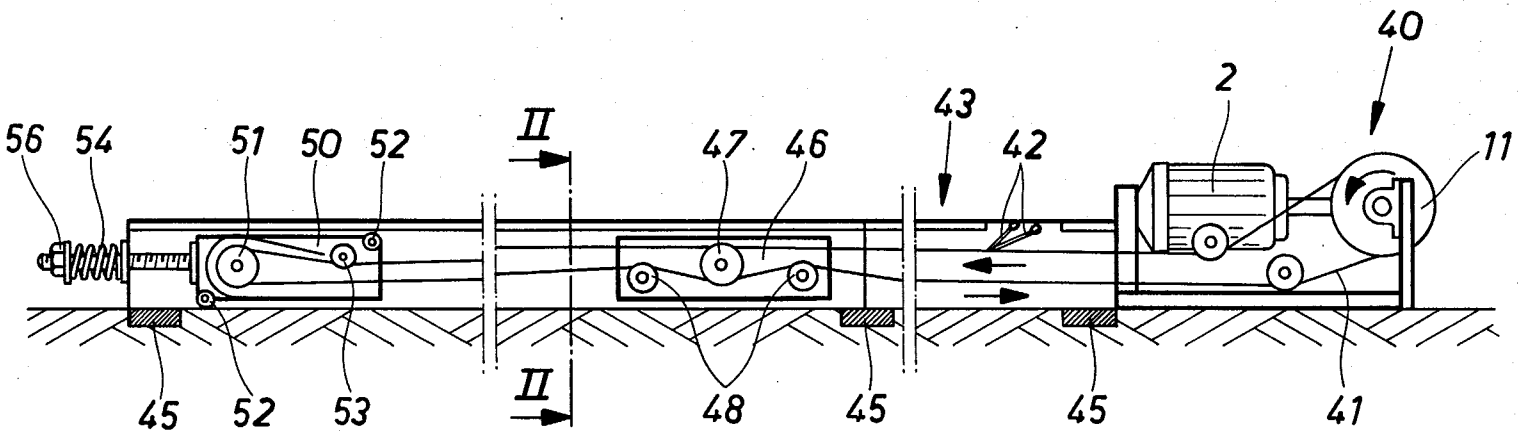
Figure 2:
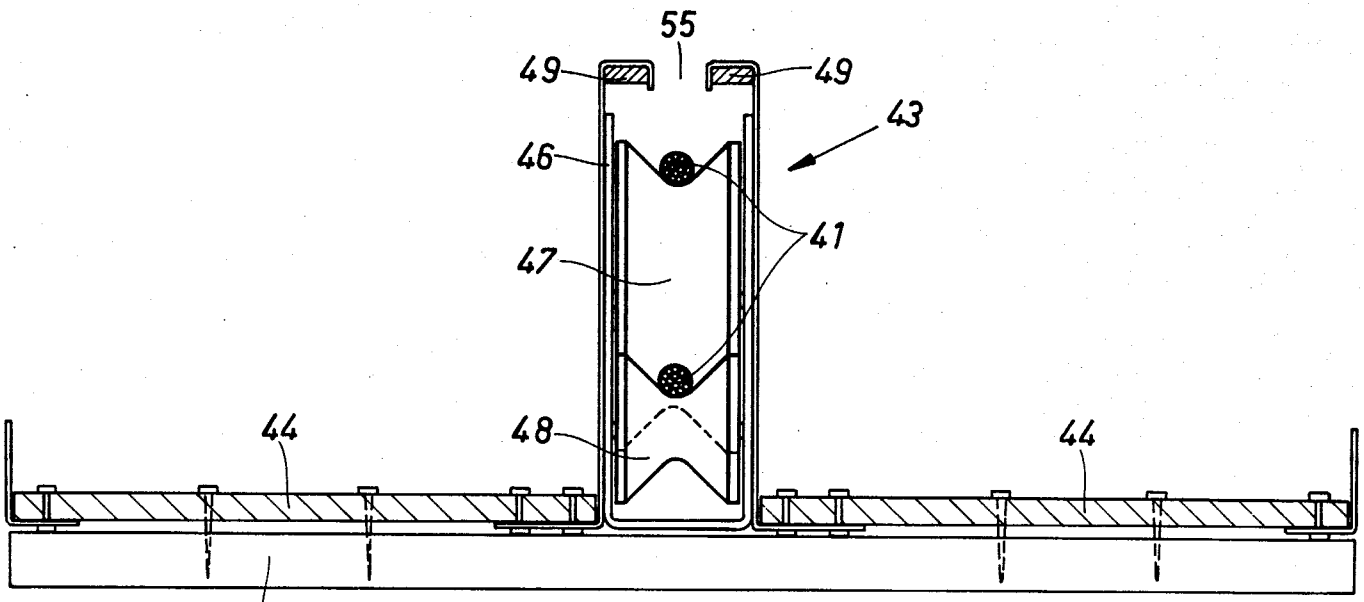
FIG. 2 shows on an enlarged scale, the section carried along the line II—II in FIG. 1.
Figure 3:
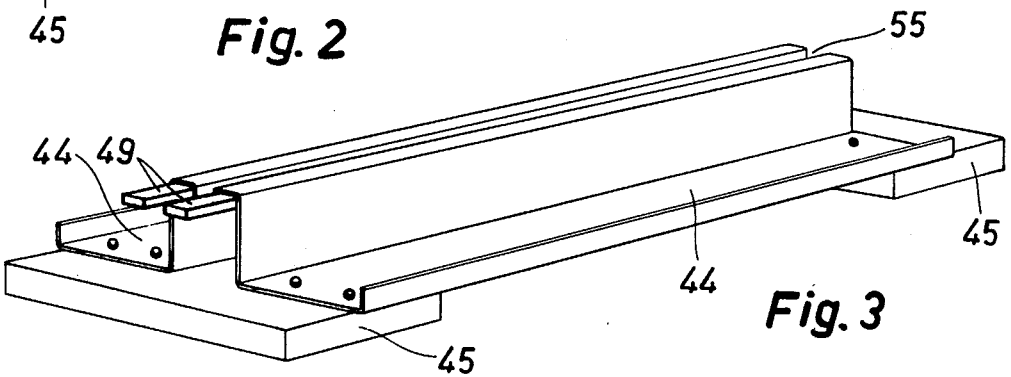
FIG. 3 shows, in perspective, a part of the towing wire housing employed in the means of the invention.

In FIG. 1, the motor drives over a transmission mechanism 40, to be described more closely later, the drive wheel 11 for the towing rope. The endless towing rope 41 is conducted inside the sheet metal housing running on the ground. With simultaneous reference to FIGS. 2 and 3, the design of the sheet metal housing shall now be described. To the lower margin of the sheet metal housing 43, on its both sides, surfaces 44 have been affixed in view of creating tracks for the skis. The sheet metal housing 43 will then remain between the jumper's feet and it will constitute guiding surfaces for the inner margins of the skis. There may be plastic and/or snow upon the surfaces 44. The housing 43 consists, for instance, of housing elements three meters in length, having at their junctures, under the housing, transversal supporting beams 45 and on the top of the housing, longitudinal joining pins 49. The beams 45 may be of wood and the surfaces 44, affixed thereto by nailing. Other materials and modes of attachment may also be contemplated.

Inside the housing 43 there are at suitable intervals, roller supports 46, having U-shaped cross-section and each of them having three consecutive rollers affixed to it. The first roller 47 lies on a level higher than the two edgemost rollers 48, whereby the return leg of the towing rope 41 runs through below the centermost roller 47 and over the rollers 48. The upper, towing leg of the towing wire 41 passes over the rollers 47 and can be pulled out through the slit 55 in the topside of the housing, whereby the ski jumper may hold the gripping members 42. The gripping members 42 have been shaped to be short rope ends with a length only little more than the breadth of the hand, whereby they cannot cause any danger to the jumper, nor will they foul the rope guiding rollers.

In order to keep the rope 41 suitably taut, and in order to facilitate the pulling out of the members 42 from the housing, the return wheel 51 at the ultimate end of the rope has been carried on a slide piece 50, which is pulled by a spring 54 in the tensioning direction of the rope 41. The location of the rollers 51 and 53 has been so chosen that the rope 41 will act on the slide piece 50 with a moment which urges the slide rolls 52 against the inner top and bottom surfaces of the housing. Hereby the slide piece 50 is enabled to move with ease longitudinally to the housing 43 as the tension of the wire 41 varies. The nut 56 may be used to regulate the tensioning force arising from the spring 54.

Before explaining, with reference to FIGS. 4 and 5, the design and operation of the drive means of the invention, the requirements imposed on the drive means shall be established. First, it shall be possible to accelerate the jumper's speed as uniformly as possible up to an ultimate velocity which may vary between 50 and 100 km per hour. Secondly, the ultimate velocity shall be adjustable to have the desired value. Thirdly, this accelerating shall always take place on an equal length, comparatively short distance, even while the jumpers vary in weight. Fourthly, the jumper himself must be able to operate the means and to determine the starting time of the towing process. All these requirements can be met by the means of the present invention, which is described in the following, making reference to FIGS. 4 and 5.

To the frame structure 1 there has been affixed a three-phase short-circuited rotor motor 2 in such way that the mounting base 3 of the motor is supported on one side by the motor swivelling axle 4 from the frame. On the other side of the motor, the mounting base 3 is supported by runner rollers 5 on the frame beam 1*a*. The spring 6 tends to pull the motor 2 together with its base 3 about the turning axle 4, but this is prevented by the lever mechanism to be described more closely later. Directly on the shaft 7 of the motor there has been mounted a fairly large diameter metallic variator disk 8 cooperating with a rubberized friction wheel 9. The friction wheel 9 has been mounted on the shaft 10 with the aid of a spline arrangement so that it can move in axial direction but takes the shaft 10 along with it in rotation. The shaft 10 is carried in bearings 12 and it rotates the towing rope drive wheel 11. The mounting beam 13 of the bearing 12' is displaceable by means of a turning lever 14, which is moved by means of the turn rod 15 and crank 16. The locking means 17 can be used to secure the crank 16 in immovable position with respect to the frame 1.

The manually operated lever 18 is carried on the frame to be turnable about the axle 19. The lever 18 has an upwardly rising projection 20 carrying a turning axle 21, to which an adjustable length arm 22 is affixed, the other end of this arm attaching at 23 to the motor base 3. When the free end of the lever 18 is moved upward, the projection 20 will move to the right in FIG. 5 and it will by mediation of the arm 22 pull the motor 2 with its base, against the force of the spring 6, around the turning axle 4. The variator disk 8 will then be urged against the friction wheel 9 with a force depending on how much the lever 18 is raised. Another lever 24 is mounted by the turning axle 25 on the end of the frame upright 1*b*. The damping spring 26 keeps the lever 24 in the position at rest of FIG. 5. The lever 24 is connected to the lever 18 by the spring 27. The spring 27 has such great strength that at the turning upward of the lever 24 it draws the lever 18 along with only a slight yielding as the load increases. The force with which turning of the lever 24 acts on the lever 18 is adjustable by moving the attachment of the spring between the holes 28. The lever 24 has a telescopically lengthenable and shortenable end 24*a*, which can be moved by turning the nut 24*b* engaging with the shifting screw and which lies between fixed lugs on the lever 24. The servomotor 29, through a step-down gear box, slowly rotates the two-armed lever 30*a* and 30*b*, of which the one arm 30*a* cooperates with the lever 24,24*a* so that as the arm 30*a* turns upward, it simultaneously turns the lever 24 upward and, further, through the spring 27, lever 18 and arm 22 moves the motor 2 with its variator disk 8 towards the friction wheel 9. Since the required travel of the variator disk is a few millimeters at a maximum, even a servomotor of rather low power, 29, is enough to furnish a high enough friction pressure force. As the arm 30*a* turns to pass by the end of the lever 24*a*, the lever 24 is released and falls down on the spring 26. At the same time the spring 6 pulls the motor with its base and the variator disk 8 is disengaged from the friction wheel 9. The acceleration phase is now concluded and after the arm 30*a* has once more arrived under the lever 24,24*a*, the arm 30*b* hits the limit switch 31 and stops the servomotor 29. The jumper may start another accelerating phase with the switch 32 positioned at the beginning of the starting track, preferably of such type that it can be kicked with the ski, and which starts the servomotor 29. The contactor housing has been indicated with the reference numeral 33, and the switch 34 is used to switch the means on for operation.

In order that after the accelerating phase the rope wheel 11 and the rope might not continue to move at high speed, a brake shoe 35 has been arranged to press against the circumference of the drive wheel 11 as soon as the contact between the variator disk 8 and the friction wheel 9 is broken. To this purpose, the brake shoe 35 has been attached by mediation of a turning lever 36 and a pull rod 37 turning same, to the axle pin 21 of the lever 18. This has the effect that upward and downward movements of the lever 18 cause the brake to be disengaged or engaged, as the case may be. The lever 18 has been made long enough to extend so that it can be grasped by the jumper standing at the starting point. The jumper may then by repeatedly raising the lever 18 establish enough contact between the variator disk 8 and the friction wheel 9 to bring the gripping members 42 on the towing rope to where he stands. After the jumper has grasped the gripping members 42 and when he decides to commence his jump, he has to push with his ski on the switch 32, whereby the servomotor starts up and begins with the aid of the lever 30*a* to raise the lever 24*a*,24 and further, over the spring 27, lever 18 and arm 22, begins to urge the variator disk 8 against the friction wheel 9. The pressure increases continuously until the lever 30*a* has reached its top position or departs from the end of the lever 24. The jumper has then arrived at the ultimate end of the track and he has reached that ultimate velocity which has been fixed by the adjustment of the friction wheel 9. The velocity as well as the accelerating length may furthermore be acted on by the length of the arm 24, to which end the telescopic extension 24*a* of this arm is moved.

Since the application of a friction coupling in the manner taught by the invention causes particularly high wear of the friction wheel 9, this wheel has been arranged in the invention to enable compensation to be effected by adjusting, from time to time, the length of the arm 22 by means of the adjusting screw 22*a* and nut 22*b*. When the arm 22 is shortened, the variator disk 8 moves closer to the friction wheel 9.

I claim:

1. An apparatus for towing a skier on skis to a ski-jump takeoff at an accelerating speed comparable to that given by a starting tower comprising an endless wire or rope carrying gripping members for grasping by a skier between an end roller and a drive roller, an electric motor with a transmission means for driving said endless wire or rope through said drive roller, said endless wire or rope being guided by rollers enclosed in a housing adapted to be straddled by a skier, the upper face of said housing having a longitudinal slit whereby said gripping members are exposed the length of said longitudinal slit, said transmission means being adapted to provide a preselected constantly increasing acceleration to said endless wire or rope during the distance of said longitudinal slit through said drive roller.

2. The apparatus of claim 1 wherein said housing has affixed on each side at the bottom thereof a longitudinal extension adapted to guide the skis of the skier during said accelerating speed.

3. The apparatus of claim 1 wherein said rollers are affixed to separate roller supports affixed to the inner walls of said housing.

4. The apparatus of claim 3 wherein said separate roller supports carry three rollers consecutively so that the central roller is at a level higher than the two edgemost rollers, whereby the lower return leg of the rope passes below the central roller but over the two edgemost rollers.

5. The apparatus of claim 1 wherein said housing consists of sections joined as extensions to each other, whereby at the section junctures under the housing there are transversal supporting beams and on the upper margin of the housing, longitudinal jointing pins.

6. The apparatus of claim 1 wherein said end roller is rotatably mounted within the end portion of said housing on a slide element movable longitudinally against the force of a spring.

7. The apparatus of claim 1 wherein said gripping members are two short rope ends.

8. The apparatus of claim 1 wherein said transmission means adapted to provide a preselected constantly increasing acceleration to said endless wire or rope consists of a large diameter variator wheel mounted on the driveshaft of a constant speed electric motor adapted to engage a friction wheel slideably mounted at right angles thereto, and means to displace said variator wheel in the direction of said friction wheel, thereby engaging said friction wheel at constantly increasing pressure, said friction wheel and said drive roller being coupled.

9. The apparatus of claim 8 wherein said means to displace said variator wheel is a lever means urging said electric motor and said variator wheel in the direction of said friction wheel against the force of a spring.

10. The apparatus of claim 9 wherein said lever means comprises a manually operated lever and a servomotor operated lever operating together.

11. The apparatus of claim 10 wherein the servomotor rotates a two-armed lever of which one arm turns the levers of said lever means and the other arm cooperates with a limit switch stopping the servomotor.

12. The apparatus of claim 11 wherein the end of the manually operated lever and the servomotor starting switch are within the jumper's reach at the beginning of the track.

13. The apparatus of claim 11 wherein the distance between said two-armed lever turned by said servomotor and said lever means in cooperation therewith is adjustable by adjusting the length of the lever means attached to said two-armed lever.

14. The apparatus of claim 9 wherein said lever means urging said electric motor and said variator wheel in the direction of said friction wheel is adjustable with reference to said electric motor and said variator wheel.

15. The apparatus of claim 9 wherein the base of said motor is supported by the frame through a turning axle on one side of said motor and by sliding members on the other side, whereby the lever means engage with the motor base on its sliding members side, and that the point of contact of the friction wheel and variator wheel also lies on the last-mentioned side of the motor's shaft.

16. The apparatus of claim 9 wherein said lever means is in association with a brake means applied against said drive roller whereby when said lever means urges said electric motor and said variator wheel in the direction of said friction wheel said brake means is released.

17. The apparatus of claim 8 wherein said friction wheel is axially slideably mounted on the shaft of said drive roller in cooperation with means to axially slideably adjust said friction wheel to the preselected final accelerated speed.

* * * * *

UNITED STATES PATENT AND TRADEMARK OFFICE

CERTIFICATE OF CORRECTION

PATENT NO. : 4,188,018

DATED : February 12, 1980

INVENTOR(S) : PERTTI PASANEN

It is certified that error appears in the above—identified patent and that said Letters Patent is hereby corrected as shown below:

In the Heading, after Item "[22]" please insert

--[30] Foreign Application Priority Data

| | | |
|---|---|---|
| Feb. 23, 1977 | Finland | 763,301 |
| Nov. 29, 1977 | Finland | 773,609 -- |

Signed and Sealed this

*First* Day of *October 1985*

[SEAL]

*Attest:*

*Attesting Officer*

DONALD J. QUIGG

*Commissioner of Patents and Trademarks—Designate*